US005261287A

United States Patent [19]

Sebor

[11] Patent Number: 5,261,287

[45] Date of Patent: Nov. 16, 1993

[54] POSITIVE ENGAGEMENT CLUTCH FOR A SUBMERSIBLE CLEANING DEVICE

[76] Inventor: Pavel Sebor, 45 Highcliff Way, Northcliff Extension 12, Johannesburg, Transvall, South Africa

[21] Appl. No.: 880,669

[22] Filed: May 11, 1992

[30] Foreign Application Priority Data

Feb. 28, 1992 [ZA] South Africa ..... 92/1505

[51] Int. Cl.[5] ..... F16D 35/00

[52] U.S. Cl. ..... 74/126; 74/577 M; 74/577 R; 192/28

[58] Field of Search ..... 74/126, 142, 575, 577 R, 74/577 M; 192/28

[56] References Cited

U.S. PATENT DOCUMENTS

| | | | |
|---|---|---|---|
| 219,698 | 9/1879 | Dean | 74/577 |
| 232,241 | 9/1880 | Coltman | 192/28 |
| 265,745 | 10/1882 | Braun | 74/577 |
| 271,132 | 1/1883 | Sayles | 74/577 |
| 286,596 | 10/1883 | Ercanbrack | 74/577 |
| 394,085 | 12/1888 | Summers | 74/577 |
| 1,001,277 | 8/1911 | Johnson | 74/577 R X |
| 1,333,689 | 3/1920 | Ulfeldt | 192/28 |
| 2,129,566 | 9/1938 | Curtis | 74/126 |
| 2,153,556 | 4/1939 | Gartin | 74/577 |
| 2,368,892 | 2/1945 | Skoog | 192/28 |
| 3,667,307 | 6/1972 | Kelch | 74/126 |
| 3,712,433 | 1/1973 | Thut | 192/8 |
| 4,401,006 | 8/1983 | Sekiguchi | 74/577 M |
| 4,788,874 | 12/1988 | Nelson et al. | 74/142 |

FOREIGN PATENT DOCUMENTS

| | | | |
|---|---|---|---|
| 104135 | 7/1899 | Fed. Rep. of Germany | 192/28 |
| 587771 | 1/1959 | Italy | 74/142 |

*Primary Examiner*—Rodney H. Bonck
*Assistant Examiner*—Ryan W. Massey
*Attorney, Agent, or Firm*—Allen, Dyer, Doppelt, Franjola & Milbrath

[57] ABSTRACT

A drive mechanism for converting a reciprocating angular movement into one directional angular movement is disclosed for driving a shaft in a submersible cleaning device. In particular, a positive engagement clutch converts an alternating pivotal or angular motion of a shaft to a unidirectional circular motion of a driven gear. The shaft is affixed to a collar formation comprising pockets in which pawl elements are movably placed. The pawl elements engage teeth of a periphery ring that encloses the collar. The driven gear is affixed to the ring. The pawl elements operate in a dense medium such as the water of a pool in which the device is operating. The water imparts a high degree of inertia to the pawl elements and cause them to engage in the peripheral ring during the alternating motion of the shaft. Rotational movement of the driven gear to one direction is accomplished using a second pawl engaging a ratchet affixed to the periphery of the ring. With this single rotation of the driven gear, a number of cleaning device functions can be performed including, for example, a dislodgement mechanism.

6 Claims, 1 Drawing Sheet

POSITIVE ENGAGEMENT CLUTCH FOR A SUBMERSIBLE CLEANING DEVICE

FIELD OF THE INVENTION

This invention relates to a drive mechanism adapted for use with a submersible cleaning device.

SUMMARY OF THE INVENTION

It is an object of the present invention to provide a novel drive mechanism for converting reciprocating angular movement into one directional angular movement for drive purposes. The term "shaft" herein includes gear, lever and the like.

According to the invention such a device comprises a toothed ring associated with a driven shaft and one or more pawl elements on a drive shaft each mounted for pivotal movement between a first extreme position wherein the pawl is generally radially disposed to engage the teeth on the rip and a second extreme position wherein the pawl is angled out of a radial direction, wherein it is disengaged from the teeth, the arrangement being one wherein the pawl elements art in a dense medium which serves to hold the pawl stationary relative to the drive shaft upon angular movement of the latter, causing the pawl to move to the first extreme position upon rotation of the shaft in one direction and to the second extreme position upon rotation of the shaft in the reverse direction.

In a preferred arrangement the dense medium within which the pawl elements operate will be the liquid wherein the surface to be cleaned is submerged.

Further according to the invention the pawl elements will be pivotally movable in a pocket defined towards the outer surface of the drive shaft, such pocket defining abutment surfaces limiting the pivotal movement of the pawl elements between the first and the second extreme positions. Still further according to the invention the toothed ring will be defined within a socket, bore or the like of the driven shaft with the drive shaft and its pawl elements accommodated within such socket or bore.

Still further according to the invention the mechanism includes means for permitting rotational movement of the driven shaft in one direction and for constraining it from movement in a reverse direction comprising a pawl and ratchet arrangement. Preferably a toothed rack for such pawl and ratchet arrangement will be provided on the outer surface of the driven shaft and the pawl therefore mounted on an external support.

BRIEF DESCRIPTION OF DRAWINGS

In order more clearly to illustrate the invention an embodiment thereof is described hereunder purely by way of example with reference to the accompanying drawings wherein.

DETAILED DESCRIPTION OF PREFERRED EMBODIMENTS

Figure 4:
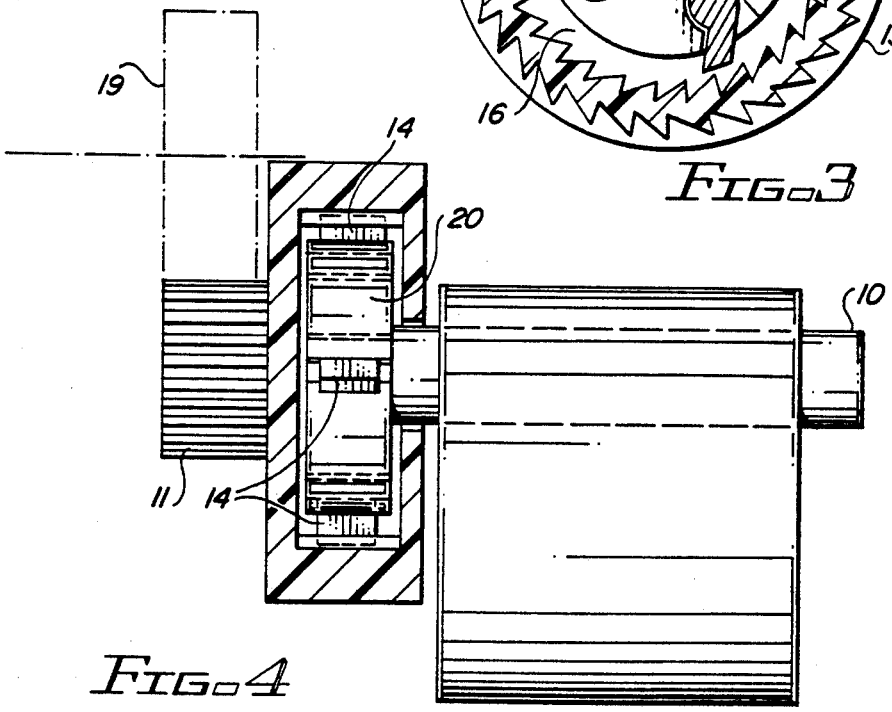
FIG. 4 is a sectioned elevation of the arrangement in FIG. 1.

Referring to the drawings a drive mechanism, for use with a submersible cleaning device, for translating reciprocating angular movement shown at 10*a* of a drive shaft 10 into one directional angular movement shown at 11*a* of a driven gear 11, is illustrated. The driven gear 11 can perform a number of functions for the pool cleaner and it is in particular envisaged that it will drive a dislodgement mechanism for a pool cleaner through a number of reduction gears, such as that shown at 19, FIG. 4.

The drive mechanism comprises a peripheral ring of teeth 12 secured or integrally formed within a drum 13 or alternatively a bore, (not shown), defined at the end of the driven gear 11 . The teeth are periodically engaged by a plurality of pawl or sprag elements 14 which are pivotally mounted on pockets 15 defined in a collar formation 20 at the end of the drive shaft 10. The collar 20 of the drive shaft 10 and the sprag elements 14 are thus disposed within the drum 13 of the driven gear 11 to enable the pawl elements 14 periodically to engage the internal teeth 12.

Figure 1:
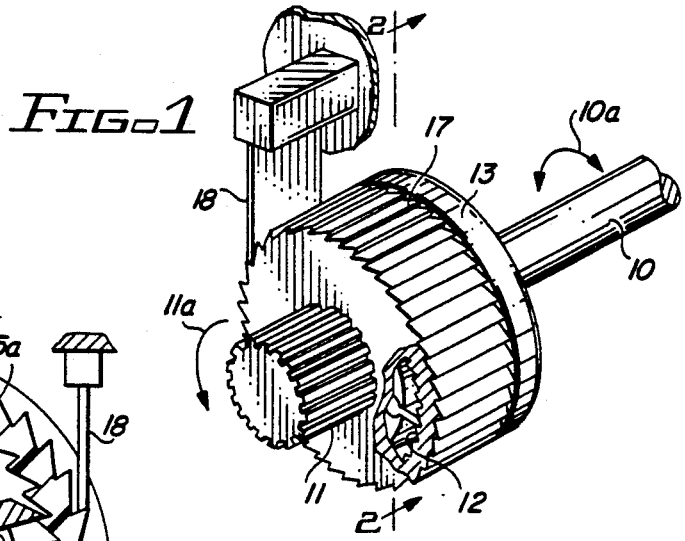
FIG. 1 is a partially sectioned perspective view of a drive arrangement in accordance with the invention.
Figure 2:
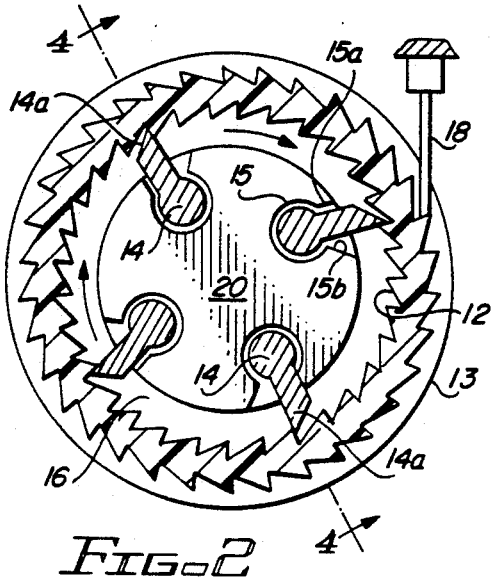
FIG. 2 is a section on line II—II in FIG. 1 illustrating angular movement of a drive shaft in one direction.
Figure 3:
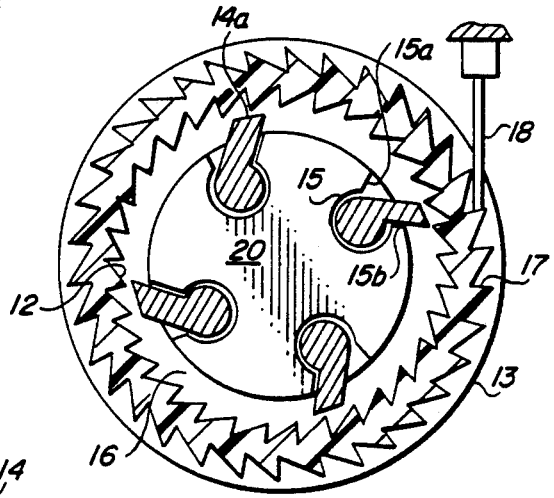
FIG. 3 is a section on line II—II in FIG. 1 illustrating movement of the drive shaft in the reverse direction to that shown in FIG. 2.

The pockets 15 which pivotally mount the pawl elements 14 define opposed abutment surfaces 15*a*, 15*b*, which act to limit pivotal movement of the pawl elements 14 between a first extreme position (shown in FIG. 2) wherein the pawl elements 14 are substantially radially disposed to engage the teeth 12; and a second extreme position (shown in FIG. 3) wherein the pawl elements 14 are angled relative to the radial and out of engagement with the teeth 12.

It is a feature of the invention that the pawl elements 14 will operate in a dense liquid medium 16, preferably the same liquid in which the surface to be cleaned is immersed, and this dense medium 16 will tend to impart a high degree inertia to the pawl elements 14. The free ends 14*a* of the pawl elements 14 will thus tend to remain stationary during angular movement of the drive shaft 10 in one direction or the other. Thus, with the pawl elements 14 in the first extreme position and radially orientated (FIG. 2), rotational movement of the drive shaft 10 in an anti-clockwise direction will cause the pawl elements 14 to move to the second extreme position (FIG. 3) and remain in such position during further anti-clockwise rotation of the drive shaft 10. Likewise, when the shaft 10 reverses its direction of rotation to a clockwise direction, the sprag elements 14 will immediately straighten out to the first extreme position wherein they are radially orientated and engage the teeth 12 of the driven shaft 11.

When the drive, shaft 10 is stationary, one or more lower pawl elements will tend to be radially orientated in engagement with the teeth 12 under the influence of gravity.

In order to limit rotational movement of the driven gear 11 to one directional movement, the invention further provides a pawl and ratchet arrangement comprising peripheral ratchet teeth 17 defined on the outer periphery of the drum 13 which are engaged by means of a pawl member 18 which is mounted independently of the drum 13.

Doubtless variations in detail of the invention are possible without departing from the principles of this disclosure.

What is claimed is:

1. Apparatus for converting a reciprocal angular movement into an angular movement in one direction for purposes of driving a shaft, the apparatus comprising:

a drive shaft operable in a reciprocal manner;

a collar fitted to the drive shaft, and having pawl elements extending radially therefrom;

a ring encircling the collar and the pawls, the ring having inside teeth engageable by the pawls, wherein a dense medium placed between the ring and the collar serves to hold the pawls stationary relative to the drive shaft upon angular movement thereof, causing the pawls to move to a first extreme position upon rotation of the shaft in one direction and to a second extreme position upon rotation of the shaft in the reverse direction, thereby engaging the teeth of the ring during such movement;

a driven gear coupled with the tooth ring; and means for limiting rotation of the ring in one direction wherein reciprocating rotation of the drive shaft causes alternate engagement of the pawls in the teeth of the ring, thereby causing rotation of the ring and the driven gear as determined by the limiting means.

2. The apparatus recited in claim 1 wherein the dense medium is water.

3. Apparatus for converting a reciprocal angular movement into an angular movement in one direction for purposes of driving a shaft, the apparatus comprising:

a toothed ring;

a drive shaft having a plurality of pawl elements the pawl elements engageable with the toothed ring, each pawl element mounted for pivotal movement between a first extreme position whereas the pawl is generally radially disposed to engage the teeth on the ring and a second extreme position wherein the pawl elements are angled out of a radial direction wherein the elements are disengaged from the teeth;

a dense medium within which the pawl elements operate, the dense medium serving to hold the pawl elements stationary relative to the drive shaft upon angular movement of the drive shaft, causing the pawl elements to move to the first extreme position upon rotation of the shaft in one direction and to the second extreme position upon rotation of the shaft in the reverse direction; and means for permitting rotational movement of the driven shaft in one direction.

4. The apparatus as recited in claim 3, wherein the unidirectional rotational means comprises a ratchet gear arrangement on the periphery of the toothed ring and a pawl engageable with the ratchet, the pawl being affixed to a support external to the drive shaft.

5. A drive mechanism for use with a submersible oscillator type pool cleaning device for translating reciprocating angular movement of a pool cleaning device oscillator into one directional angular movement, the drive mechanism comprising:

a drive shaft;

a drum having a peripheral ring of teeth secured within the drum and ring of ratchet teeth on the outer periphery of the drum;

a collar formation affixed at one end of the drive shaft, the collar having a plurality of pockets about its periphery, the pockets defined by opposed abutment surfaces;

a plurality of pawl elements pivotally mounted within the pockets for movement between a first extreme position against one abutment surface wherein the elements are substantially radially disposed to engage the inner drum teeth and a second extreme position against the opposite abutment surface wherein the pawl elements are angled relative to the radial and out of engagement with the teeth;

a dense medium located within the drum, the dense medium acting on the free ends of the pawls during angular movement of the drive shaft; and a pawl engageable with the ratchet teeth for limiting rotation of the drum to one direction.

6. The drive mechanism as recited in claim 5 wherein the dense medium is the pool water within which the cleaning device is submerged.

* * * * *